US012203265B2

(12) United States Patent
Dweib et al.

(10) Patent No.: US 12,203,265 B2
(45) Date of Patent: Jan. 21, 2025

(54) SULFUR PIT ROOF DEGRADATION MITIGATION

(71) Applicant: SAUDI ARABIAN OIL COMPANY, Dhahran (SA)

(72) Inventors: Mahmoud A. Dweib, Dhahran (SA); Emad Abu-Aisheh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 183 days.

(21) Appl. No.: 18/153,204

(22) Filed: Jan. 11, 2023

(65) Prior Publication Data

US 2024/0229453 A1 Jul. 11, 2024

(51) Int. Cl.
*E04B 1/68* (2006.01)
*B65D 88/76* (2006.01)

(52) U.S. Cl.
CPC ..... *E04B 1/6815* (2013.01); *B65D 88/76* (2013.01); *E04B 1/6801* (2013.01); *E04B 1/6812* (2013.01)

(58) Field of Classification Search
CPC ..... E04B 1/6815; E04B 1/6801; E04B 1/6812
See application file for complete search history.

(56) References Cited

U.S. PATENT DOCUMENTS 3,713,263 A * 1/1973 Mullen ..... E04D 13/151 52/396.04
3,827,204 A * 8/1974 Walters ..... E04F 15/02 404/66
5,426,148 A 6/1995 Tucker
6,401,416 B1 * 6/2002 Ytterberg ..... E04B 1/6801 52/573.1
6,403,711 B1 6/2002 Yang et al.
6,624,232 B2 9/2003 Wilson, Sr.
6,685,196 B1 * 2/2004 Baerveldt ..... E04B 1/6812 277/654
6,997,640 B1 * 2/2006 Hohmann, Jr. ..... E04B 1/6801 14/73.1
8,029,854 B2 10/2011 Johnston
8,047,550 B2 * 11/2011 Behrens ..... E04B 1/948 277/921
9,822,499 B2 11/2017 Yan et al.
10,422,127 B2 9/2019 Hensley et al.
10,538,383 B2 1/2020 Al-Mehthel et al.
10,570,611 B2 2/2020 Hensley et al.
10,794,056 B2 10/2020 Hensley et al.
10,815,658 B2 10/2020 Danna et al.
(Continued)

*Primary Examiner* — Rodney Mintz
(74) *Attorney, Agent, or Firm* — Vorys, Sater, Seymour and Pease LLP

(57) ABSTRACT

A sulfur pit that mitigates water ingress may include a concrete slab roof that comprises a first concrete slab and a second concrete slab; a polymer sealant disposed on an exterior surface of the concrete slab roof; a refractory layer disposed on an interior surface of the concrete slab roof; and at least one expansion joint located in the gap between the first concrete slab and the second concrete slab. The expansion joint may include a fiber rope disposed in the gap between the first concrete slab and the second concrete slab; a fluoroelastomer caulk located (a) in a first spacing between the fiber rope and the first concrete slab and (b) in a second spacing between the fiber rope and the second concrete slab; and a steel plate spanning the gap between the first concrete slab and the second concrete slab.

15 Claims, 3 Drawing Sheets

(56) References Cited

U.S. PATENT DOCUMENTS

| | | | | |
|---|---|---|---|---|
| 10,934,381 | B2 | 3/2021 | Lu et al. | |
| 11,066,592 | B2 | 7/2021 | Taha et al. | |
| 2002/0115775 | A1* | 8/2002 | Wilson, Sr. | C04B 28/04 524/424 |
| 2004/0066006 | A1* | 4/2004 | Baerveldt | E04B 1/6812 277/590 |
| 2009/0029042 | A1* | 1/2009 | Johnston | C04B 41/71 427/140 |
| 2010/0199583 | A1* | 8/2010 | Behrens | B64G 1/58 52/716.6 |
| 2012/0211391 | A1* | 8/2012 | Al-Mehthel | B65D 88/744 206/524.1 |
| 2017/0121918 | A1* | 5/2017 | Yan | E01D 21/00 |
| 2018/0163393 | A1* | 6/2018 | Danna | E04B 1/6801 |
| 2018/0371746 | A1* | 12/2018 | Hensley | B29C 44/5618 |
| 2018/0371747 | A1* | 12/2018 | Hensley | E04B 1/6812 |
| 2019/0211546 | A1* | 7/2019 | Hensley | B32B 7/12 |
| 2019/0256634 | A1* | 8/2019 | Lu | C08K 5/14 |
| 2020/0123431 | A1* | 4/2020 | Taha | C09K 8/44 |
| 2024/0093040 | A1* | 3/2024 | Dweib | C09D 7/69 |

* cited by examiner

SULFUR PIT ROOF DEGRADATION MITIGATION

FIELD OF THE DISCLOSURE

The present disclosure relates generally to sulfur pits.

BACKGROUND OF THE DISCLOSURE

Sulfur storage units including sulfur pits are used as a holding tank for elemental sulfur in refinery processes. The sulfur pit maintains the sulfur in a molten state, typically in excess of 150° C. and, in some instances, even up to or in excess of 180° C. The origin of sulfur located in sulfur pits is typically from hydrocarbons such as petroleum or natural gas. Sulfur is typically removed from these hydrocarbons during refinery processing and stored in sulfur storage units like sulfur pits.

Sulfur pits are typically built using concrete reinforced with steel rebar and have columns or beams to support the roof of the sulfur pit. The location of sulfur pits are typically buried underground with the external side of the concrete roof of the sulfur pit exposed to the surrounding environment.

Cured concrete structures are by nature porous due to evaporation of water out of the concrete mix during the curing process. Also, concrete is prone to cracks due to the drying or temperature shrinking that occurs when the concrete mix cures and cools down. Accordingly, the concrete roofs or walls of sulfur pits likely have micro-porosity and cracks that may not be readily visible. In addition, concrete structure for the sulfur recovery unit is built with expansion joints to allow for expansion and shrinkage with minimum harm to the structure due to the associated stress build up, which may be caused by the temperature differential between opposing faces of a concrete element. Ingress of water through the concrete body and through the expansion joints into the sulfur pit, combined with the elevated temperature therein, can cause the formation of sulfuric acid, a very corrosive chemical species, which leads to deterioration of the sulfur pit concrete structure.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

A nonlimiting system of the present disclosure comprises: a sulfur pit comprising a concrete slab roof, wherein the concrete slab roof comprises a first concrete slab and a second concrete slab, wherein the first concrete slab and the second concrete slab are located adjacent to each other and are coplanar, and wherein there is a gap between the first concrete slab and the second concrete slab; a polymer sealant disposed on an exterior surface of the concrete slab roof, wherein the exterior surface is directed toward an exterior of the sulfur pit, and wherein the exterior surface comprises exterior faces of the first concrete slab and the second concrete slab; a refractory layer disposed on an interior surface of the concrete slab roof, wherein the interior surface is directed toward an interior of the sulfur pit, and wherein the interior surface comprises downward faces of the first concrete slab and the second concrete slab; and at least one expansion joint located in the gap between the first concrete slab and the second concrete slab.

A nonlimiting method of the present disclosure comprises: providing a sulfur pit comprising a concrete slab roof, wherein the concrete slab roof comprises a first concrete slab and a second concrete slab, wherein the first concrete slab and the second concrete slab are located adjacent to each other and are coplanar, and wherein there is a gap between the first concrete slab and the second concrete slab; disposing a polymer sealant on an exterior surface of the concrete slab roof, wherein the exterior surface is directed toward an exterior of the sulfur pit, and wherein the exterior surface comprises exterior faces of the first concrete slab and the second concrete slab; disposing a refractory layer on an interior surface of the concrete slab roof, wherein the interior surface is directed toward an interior of the sulfur pit, and wherein the interior surface comprises downward faces of the first concrete slab and the second concrete slab; and affixing at least one expansion joint in the gap between the first concrete slab and the second concrete slab.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
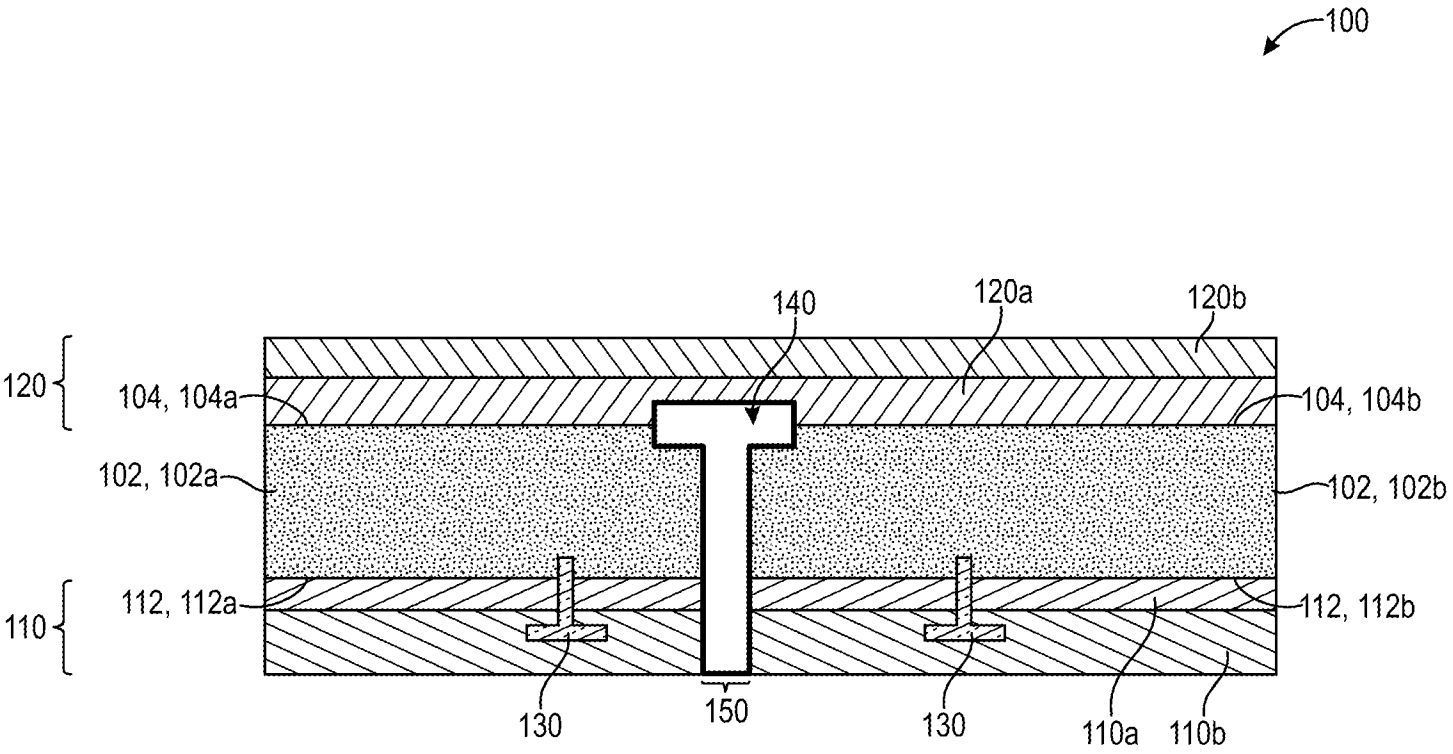
FIG. 1 illustrates a nonlimiting example sulfur pit roof system according to the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to sulfur pits and, more particularly, to systems and methods that mitigate water ingress so as to mitigate the deterioration of the concrete structures of the sulfur pits. Systems and methods of the present disclosure utilize a sulfur pit roof having a polymer sealant disposed on an exterior surface of the sulfur pit roof, a refractory layer disposed on an interior surface of the sulfur pit roof, and at least one sealed expansion joint. These three features of the sulfur pit roof combined may mitigate ingress of water and other contaminants to the sulfur pit and, consequently, offer an increased level of corrosion mitigation for the sulfur pit structure as a whole.

Without being bound by theory, the mitigation of water and contaminant ingress may reduce the formation of sulfuric acid. Preventing or reducing ingress of water via the sulfur pit roof may reduce the rate of corrosion of the sulfur pit due to reduced reaction of the sulfuric acid in a corrosion reaction, thereby extending the lifetime of the sulfur pit.

Further, the refractory layer disposed on the interior surface of the sulfur pit roof may reduce an exterior temperature of the sulfur pit roof. The structural integrity of polymer sealants can weaken over time, which is hastened at elevated temperatures. Reducing the exterior temperature of the sulfur pit roof, where the polymer sealant is located, may further increase the lifetime and efficacy of the systems and methods of the present disclosure.

A nonlimiting example system of the present disclosure is shown in FIG. 1. System 100 includes a concrete slab roof 102 comprising a first concrete slab 102*a* and a second concrete slab 102*b*. The concrete slabs 102*a* and 102*b* have a gap 150 therebetween with an expansion joint 140 at the gap 150. The system 100 includes a polymer sealant 120 disposed on an exterior surface 104*a* and 104*b* of the concrete slabs 102*a* and 102*b*. The illustrated polymer sealant 120 comprises a first exterior layer 120*a* and a second exterior layer 120*b*, where the first exterior layer 120*a* is disposed between the exterior surfaces of the concrete slabs 102*a* and 102*b* and the second exterior layer 120*b*. The system 100 includes a refractory layer 110 disposed on an interior surface 112*a* and 112*b* of the concrete slabs 102*a* and 102*b*. The illustrated refractory layer 110 comprises a first interior layer 110*a* and a second interior layer 110*b*, where the first interior layer 110*a* is disposed between the interior surfaces of the concrete slabs 102*a* and 102*b* and the second interior layer 110*b*. The system 100 may further comprise at least one anchor 130 joining the refractory layer 110 to the concrete slab 102 through the interior surfaces of the concrete slabs 112. It should be noted that system 100 shows two anchors 130; however, one or more than one anchor 130 may be present in a system according to the present disclosure.

The concrete slab roof may comprise concrete and rebar disposed internally within the concrete. The rebar may comprise any suitable reinforcement material, preferably steel rebar. The concrete slab roof may be supported by columns or beams of the sulfur pit. The concrete slab roof may comprise one or more concrete slabs that may be joined by one or more expansion joints, depending on the sulfur pit size.

The concrete slab roof may have an exterior surface, wherein the exterior surface of the concrete slab roof is directed to the exterior of the sulfur pit, and wherein the exterior surface comprises exterior faces of the concrete slabs comprising the concrete slab roof.

While the polymer sealant is illustrated in FIG. 1 as a two-layer polymer sealant, the polymer sealant may be any number of layers including 1 layer to 15 layers or more. For example, a two-layer polymer sealant disposed on the exterior surface of the concrete slab roof may comprise a first exterior layer and a second exterior layer. The first exterior layer may be in contact with the exterior surface of the concrete slabs of the concrete slab roof, and the second exterior layer may be disposed on top of the first exterior layer. For a three-layer polymer sealant, a third exterior layer may be disposed on top of the second exterior layer.

The polymer sealant may comprise any suitable polymers that are preferably water-resistant, suitably adherent to adjacent layers or structures, and suitably pliable to allow for expansion and contraction with minimal to no mechanical failure. Examples of polymers that may be used in any layer of the polymer sealant may include, but are not limited to, epoxy resins, polyurethane (e.g., polyurethane elastomers), polyurea (e.g., polyurea elastomers), the like, and any combination thereof. By way of nonlimiting example, in FIG. 1, the first exterior layer may comprise an epoxy resin, and the second exterior layer may comprise a polyurethane elastomer.

Any suitable epoxy resin may be used including, but not limited to, bisphenol-A based epoxy resin, a bisphenol-F based epoxy resin, an aliphatic epoxy resin, an aromatic epoxy resin, and a Novolac resin, the like, or any combination thereof. The epoxy resin may comprise a low-viscosity epoxy resin. Without being bound by theory, the epoxy resin may act as a primer for the second exterior layer allowing the second exterior layer to adhere to the epoxy resin. Additionally, the epoxy resin may prevent ingress of water to the sulfur pit by filling in cracks within the sulfur pit roof.

Any suitable polyurethane elastomer may be used including a polyurethane elastomer sealant. The polyurethane elastomer may comprise an ultraviolet (UV)-resistant polyurethane elastomer. Suitable polyurethane elastomer may be obtained from Sika®.

Each layer of the polymer sealant (including the first exterior layer, the second exterior layer, or any combination thereof) may have any suitable thickness including a thickness of from 0.01 mm to 5 mm (or 0.1 mm to 5 mm, or 0.01 mm to 1 mm, or 0.1 mm to 1 mm, or 1 mm to 4 mm). Thicknesses outside said ranges are also contemplated.

The polymer sealant (including the first exterior layer, the second exterior layer, or any combination thereof) may further comprise one or more additional additives that may provide properties such as corrosion resistance, added strength, and the like. The one or more additives may be of any suitable size and in any suitable quantity. Suitable additives may include, but are not limited to, a plurality of particles (e.g., microparticles, nanoparticles (e.g., silica nanoparticles), polymer particles, or any combination thereof), a plurality of fibers, the like, or any combination thereof. "Nanoparticle(s)" as used herein refers to a particle which may have a number average diameter from about 1 nanometers (nm) to about 1000 nm. As a nonlimiting illustrative example, the polymer sealant may comprise silica nanoparticles in the first exterior layer and the second exterior layer. As another nonlimiting illustrative example, in another embodiment the polymer sealant may comprise silica nanoparticles only in a layer comprising a polyurethane elastomer.

The concrete slab roof may have an interior surface, wherein the interior surface is directed toward an interior of the sulfur pit, and wherein the interior surface comprises interior faces of the concrete slabs comprising the concrete slab roof.

While the refractory layer is illustrated in FIG. 1 as a two-layer refractory layer, the refractory layer may be any number of layers including 1 layer to 15 layers or more. For example, a two-layer refractory layer on the interior surface of the concrete slab roof may comprise a first interior layer and a second interior layer. The first interior layer may be in contact with the concrete slabs of the concrete slab roof, and the second interior layer may be disposed below the first interior layer. For a three-layer refractory layer, a third interior layer may be disposed below the second interior layer.

As a nonlimiting example, the first interior layer may comprise an asphalt layer. The asphalt layer may comprise an asphaltic mastic. The asphalt layer may comprise a urethane asphalt (asphalt with a polyurethane binder instead of a bitumen binder). The urethane asphalt may be of any suitable type. In particular the urethane asphalt may be of a high temperature-resistant type. The first interior layer may have any suitable thickness including a thickness of from 0.01 to 5 mm (or 3 mm to 5 mm, or 1.5 mm to 3 mm, or 1.5 mm to 5 mm, or 0.1 mm to 5 mm, or 0.01 mm to 1 mm, or 0.1 mm to 1 mm, or 1 mm to 4 mm). Thicknesses outside said ranges are also contemplated. It should be noted that one or more coats of asphalt may be applied to form a singular asphalt layer.

As a nonlimiting example, the second interior layer may comprise a silicate compound. The silicate may comprise any suitable silicate compound, preferably a potassium-silicate compound, more preferably an acid-resistant potassium-silicate compound. The second interior layer may have any suitable thickness including a thickness of from 50 mm to 100 mm (or 50 mm to 75 mm, or about 50 mm, or greater than 100 mm). Thicknesses outside said ranges are also contemplated. As a nonlimiting example, the thickness of the second interior layer may be calculated based on the R value of the silicate compound, internal temperature of the sulfur pit, or any combination thereof.

The system may further comprise at least one anchor, wherein the at least one anchor joins the refractory layer to the interior surface of the concrete slab roof. The at least one anchor may comprise any suitable anchor shape, size, and material for joining the refractory layer to the concrete slab roof. The at least one anchor may preferably comprise a steel anchor, and more preferably comprise a stainless steel anchor. The at least one anchor may extend from the first interior layer and the second interior layer to the concrete slab roof, or may extend from the first interior layer to the concrete slab roof. The at least one anchor may comprise at least two anchors. The at least two anchors may have a spacing from a first anchor to a second anchor from 150 mm to 350 mm (or 50 mm to 400 mm, or 280 mm to 320 mm).

Figure 2:
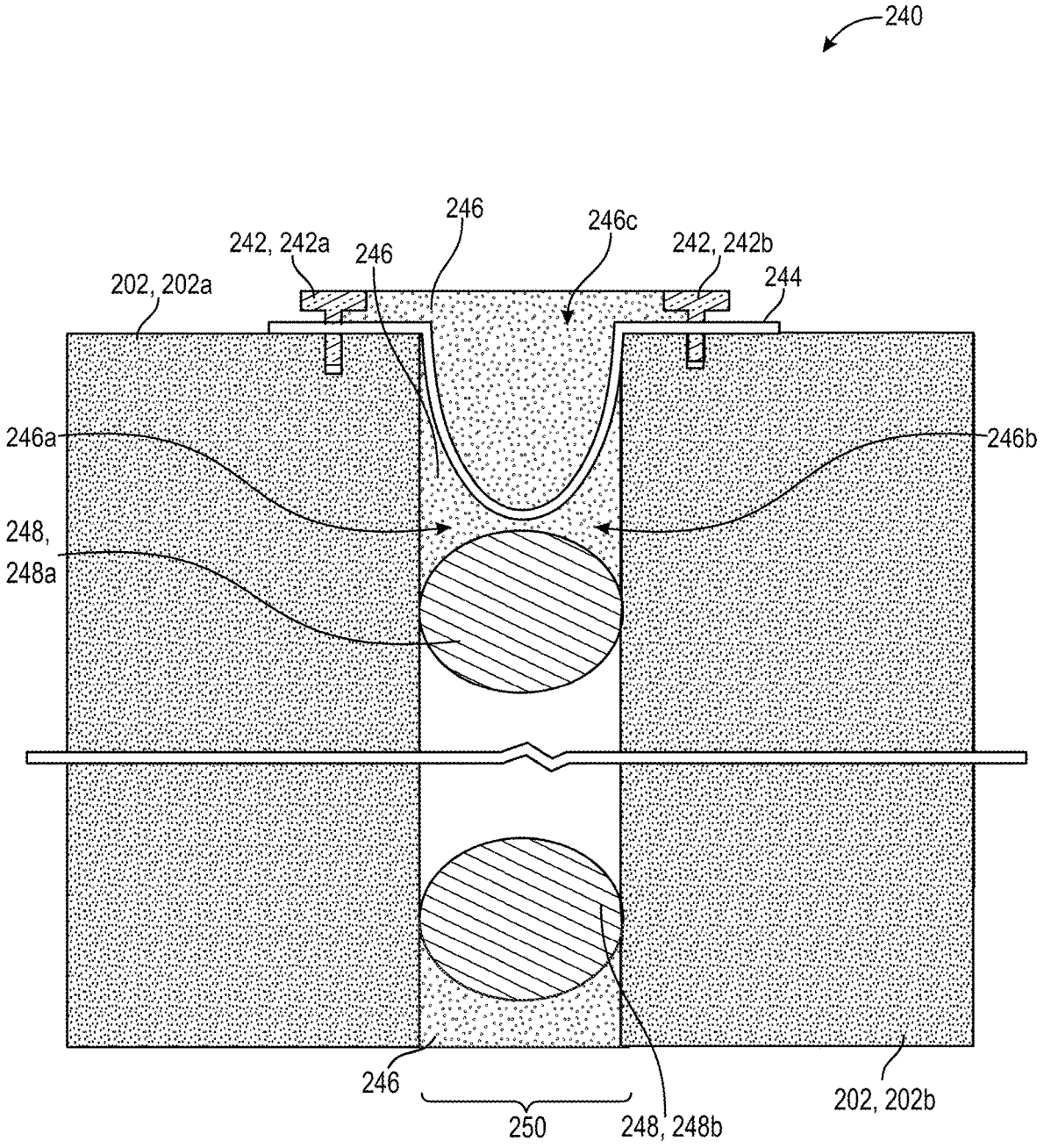
FIG. 2 illustrates a side view of a nonlimiting example expansion joint according to the present disclosure.

The system may further comprise at least one expansion joint. A side view of a nonlimiting example expansion joint is illustrated in FIG. 2. Expansion joint 240 includes a concrete slab roof comprising a first concrete slab 202*a* and a second concrete slab 202*b*. Expansion joint 240 includes a gap 250 between the first concrete slab 202*a* and the second concrete slab 202*b*. Expansion joint 240 includes a steel plate 244 spanning the gap 250 and includes fasteners 242, affixing steel plate 244 to the first concrete slab 202 via a first fastener 242*a*, and affixing steel plate 244 to the second concrete slab 202*b* via a second fastener 242*b*. It should be noted that although the steel plate 244 in expansion joint 240 is curved, the steel plate 244 may be of any suitable shape as described below. Expansion joint 240 further comprises fiber rope 248 comprising two lengths of fiber rope 248 within the gap 250. The two lengths of fiber rope include a first length 248*a* and a second length 248*b*. The expansion joint 240 may furthermore comprise fluoroelastomer caulk 246 located in a first spacing 246*a* between the fiber rope 248 and the first concrete slab 202*a* and located in a second spacing 246*b* between the fiber rope 248 and the second concrete slab 202*b*. The expansion joint 240 may furthermore comprise fluoroelastomer caulk 246 located in a third spacing 246*c* disposed at least partially on the exterior surface of steel plate 244.

The expansion joint 240 illustrated in FIG. 2 maybe incorporated into FIG. 1 where the polymer sealant 120 of FIG. 1 would be disposed not only on the exterior surfaces of the concrete slabs 102*a* and 102*b* but also may be disposed, at least partially, on exterior surfaces of: the steel plate 244, the fluoroelastomer caulk 246 located in the third spacing 246*c*, the fasteners 242, or any combination thereof.

Figure 3:
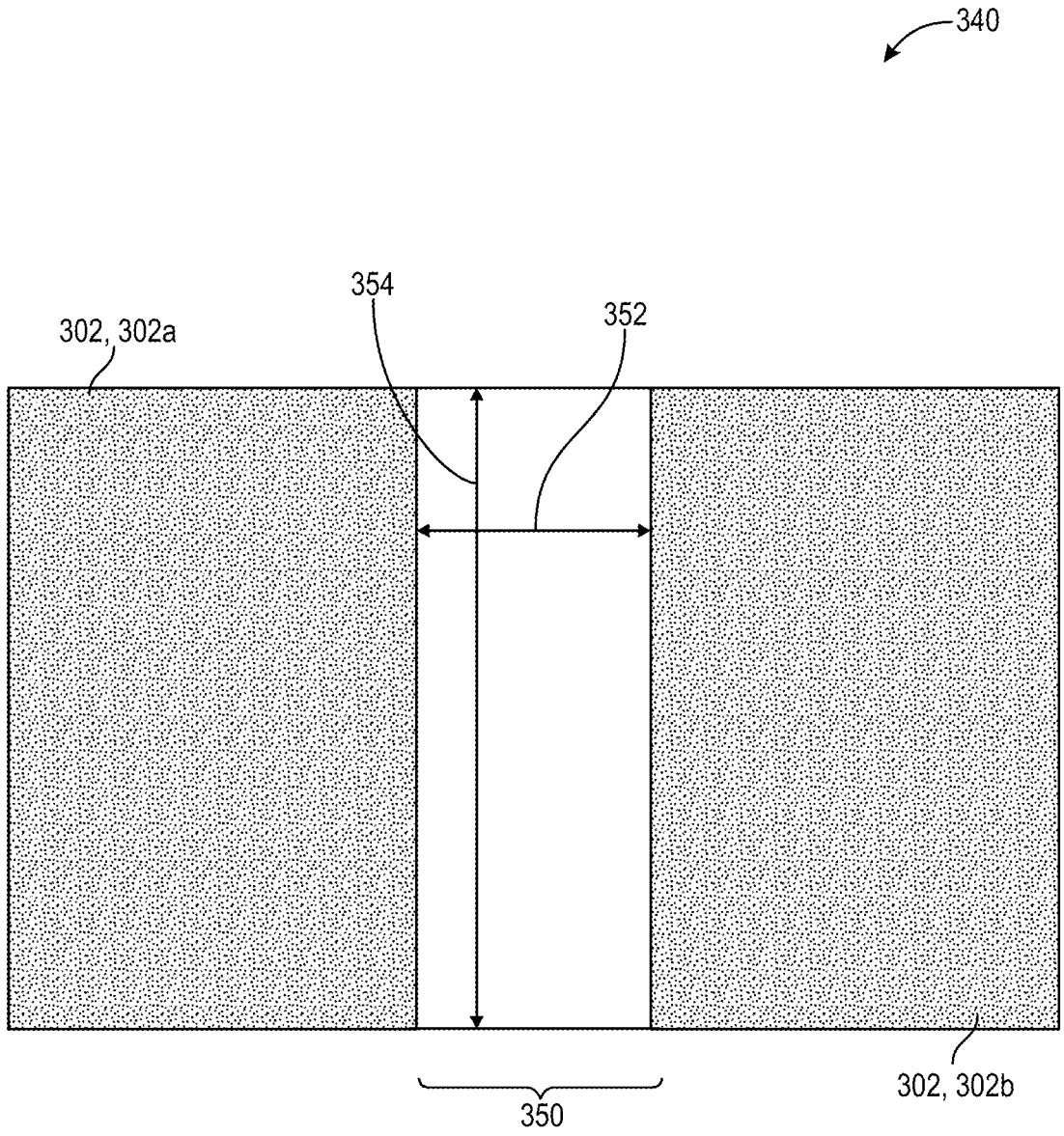
FIG. 3 illustrates a top view of a nonlimiting example expansion joint according to the present disclosure.

A top-down view of a nonlimiting example expansion joint is shown in FIG. 3. Expansion joint 340 has a gap 350 between concrete slabs 302, including a first concrete slab 302*a* and a second concrete slab 302*b*. A width 352 of the expansion joint 340 is indicated by a horizontal dashed arrow. A length 354 of the expansion joint 340 is indicated by a vertical dashed arrow.

The expansion joint may have any suitable dimension. The expansion joint may have a width suitable to span the gap between two slabs of concrete in the concrete slab roof of the sulfur pit. The expansion joint may preferably have a width from 10 mm to 100 mm (or 20 mm to 40 mm, or 10 mm to 20 mm, or 40 mm to 50 mm, or 20 mm to 100 mm). Widths outside said ranges are also contemplated. The expansion joint may have a length suitable to span the gap between the two slabs of concrete in the concrete slab roof of the sulfur pit. The expansion joint may preferably have a length from 0.1 m to 100 m (or 1 m to 100 m, or 1 m to 50 m, or 5 m to 30 m, or 1 m to 30 m, or 30 m to 50 m, or 30 m to 100 m, or greater than 100 m). Lengths outside said ranges are also contemplated.

The expansion joint may comprise any suitable steel plate, preferably a stainless steel plate, more preferably a stainless steel plate comprising grade 316 stainless steel. The steel plate may have a thickness from 1 mm to 10 mm (or 1 mm to 5 mm, or about 2 mm). Thickness outside said ranges are also contemplated. The steel plate may have curves (e.g., an upward curve, or a downward curve), bends, the like or any combination thereof at the gap of the expansion joint. The curve, bend, or the like of the steel plate may serve to allow flexibility of the expansion joint as the gap contracts, expands, or both contracts and expands.

The expansion joint may comprise a fastener for attaching the steel plate to the concrete slabs. Any suitable fastener may be used including, but not limited to, a bolt, a screw, a nail, a staple, the like, or any combination thereof. The fastener may be of any suitable material including, but not limited to, a polymer, a metal, a ceramic, a fiber, the like, or any combination thereof.

The expansion joint may comprise a fiber rope. Suitable fiber ropes should be compatible with the conditions of the expansion joint. The fiber rope may insulate the sulfur pit roof thermally. It should be noted that while the fiber rope is illustrated in FIG. 1 as comprising two lengths, the polymer sealant may be any number of lengths including 1 length to 8 lengths or more. The fiber rope may comprise any suitable fiber rope that may be twisted, braided, or a combination thereof. The fiber rope may include, but is not limited to, glass fiber, ceramic fiber, steel wire (e.g. stainless steel wire) the like, or any combination thereof. A nonlimiting example fiber rope may comprise a twisted rope comprising ceramic fiber yarn, fiberglass, and stainless steel wire. Another nonlimiting example fiber rope may comprise a braided rope comprising a ceramic fiber enclosed in a glass fiber braid or enclosed in a stainless steel wire braid. Suitable fiber rope includes ZETEX® Fiberglass Rope (available from Newtex), NEXTEL™ rope (available from 3M), and Ceramic Fiber Rope (available from Murugappa Morgan Thermal Ceramics).

The fluoroelastomer caulk may comprise any suitable caulk capable of filling spacings of the expansion joint. The fluoroelastomer caulk may be selected to withstand the temperature conditions and the acidic environment of the sulfur pit. Suitable fluoroelastomer caulk includes VITON® caulk (available from Sauereisen) or PELSEAL® (available from Pelseal Technologies).

The present disclosure includes a method comprising: providing a sulfur pit comprising a concrete slab roof; disposing a polymer sealant on an exterior surface of the concrete slab roof; disposing a refractory layer on an interior surface of the concrete slab roof; and affixing at least one expansion joint in the gap between the first concrete slab and the second concrete slab.

Additional Embodiments

Embodiment 1. A system comprising: a sulfur pit comprising a concrete slab roof, wherein the concrete slab roof comprises a first concrete slab and a second concrete slab, wherein the first concrete slab and the second concrete slab are located adjacent to each other and are coplanar, and wherein there is a gap between the first concrete slab and the second concrete slab; a polymer sealant disposed on an exterior surface of the concrete slab roof, wherein the exterior surface is directed toward an exterior of the sulfur pit, and wherein the exterior surface comprises exterior faces of the first concrete slab and the second concrete slab; a refractory layer disposed on an interior surface of the concrete slab roof, wherein the interior surface is directed toward an interior of the sulfur pit, and wherein the interior surface comprises downward faces of the first concrete slab and the second concrete slab; and at least one expansion joint located in the gap between the first concrete slab and the second concrete slab.

Embodiment 2. The system of Embodiment 1, wherein the polymer sealant comprises a first exterior layer and a second exterior layer, wherein the first exterior layer comprises an epoxy resin, and wherein the second exterior layer comprises a polyurethane elastomer.

Embodiment 3. The system of Embodiment 2, wherein the second exterior layer has a thickness of from 1 mm to 4 mm.

Embodiment 4. The system of any one of Embodiments 1-3, wherein the polymer sealant further comprises a plurality of silica nanoparticles.

Embodiment 5. The system of any one of Embodiments 1-4, wherein the polymer sealant further comprises a plurality of fibers, a plurality of particles, or any combination thereof.

Embodiment 6. The system of any one of Embodiments 1-5, wherein the refractory layer comprises a first interior layer and a second interior layer, wherein the first interior layer comprises a asphalt layer, and wherein the second interior layer comprises a potassium silicate compound.

Embodiment 7. The system of Embodiment 6, wherein the second interior layer has a thickness of greater than 50 mm.

Embodiment 8. The system of any one of Embodiments 1-7, further comprising at least one anchor, wherein the at least one anchor joins the refractory layer to the interior surface of the concrete slab roof.

Embodiment 9. The system of Embodiment 8, wherein the at least one anchor comprises a steel anchor.

Embodiment 10. The system of any one of Embodiments 1-9, wherein the at least one expansion joint comprises: a fiber rope, wherein the fiber rope is disposed in the gap between the first concrete slab and the second concrete slab; a fluoroelastomer caulk, wherein the fluoroelastomer caulk is located in a first spacing between the fiber rope and the first concrete slab, and wherein the fluoroelastomer caulk is located in a second spacing between the fiber rope and the second concrete slab; and a steel plate spanning the gap between the first concrete slab and the second concrete slab, wherein the steel plate is anchored by a first fastener to the first concrete slab, and wherein the steel plate is anchored by a second fastener to the second concrete slab.

Embodiment 11. The system of Embodiment 10, wherein the first fastener and the second fastener comprise: a bolt, a screw, a nail, a staple, or any combination thereof.

Embodiment 12. The system of any one of Embodiments 1-11, wherein the at least one expansion joint has a width from 10 mm to 100 mm.

Embodiment 13. The system of any one of Embodiments 1-12, wherein the at least one expansion joint has a length from 5 m to 30 m.

Embodiment 14. A method comprising: providing a sulfur pit comprising a concrete slab roof, wherein the concrete slab roof comprises a first concrete slab and a second concrete slab, wherein the first concrete slab and the second concrete slab are located adjacent to each other and are coplanar, and wherein there is a gap between the first concrete slab and the second concrete slab; disposing a polymer sealant on an exterior surface of the concrete slab roof, wherein the exterior surface is directed toward an exterior of the sulfur pit, and wherein the exterior surface comprises exterior faces of the first concrete slab and the second concrete slab; disposing a refractory layer on an interior surface of the concrete slab roof, wherein the interior surface is directed toward an interior of the sulfur pit, and wherein the interior surface comprises downward faces of the first concrete slab and the second concrete slab; and affixing at least one expansion joint in the gap between the first concrete slab and the second concrete slab.

Embodiment 15. The method of Embodiment 14, wherein the polymer sealant comprises a first exterior layer and a second exterior layer, wherein the first exterior layer comprises an epoxy resin, and wherein the second exterior layer comprises a polyurethane elastomer.

Embodiment 16. The method of Embodiment 15, wherein the second exterior layer has a thickness of from 1 mm to 4 mm.

Embodiment 17. The method of any one of Embodiments 14-16, wherein the polymer sealant further comprises a plurality of silica nanoparticles.

Embodiment 18. The method of any one of Embodiments 14-17, wherein the polymer sealant further comprises a plurality of fibers, a plurality of particles, or any combination thereof.

Embodiment 19. The method of any one of Embodiments 14-18, wherein the refractory layer comprises a first interior layer and a second interior layer, wherein the first interior layer comprises an asphalt layer, and wherein the second interior layer comprises a potassium silicate compound.

Embodiment 20. The method of Embodiment 19, wherein the second interior layer has a thickness of greater than 50 mm.

Embodiment 21. The method of any one of Embodiments 14-20, further comprising at least one anchor, wherein the at least one anchor joins the refractory layer to the interior surface of the concrete slab roof.

Embodiment 22. The method of Embodiment 21, wherein the at least one anchor comprises a steel anchor.

Embodiment 23. The method of any one of Embodiments 14-22, wherein the at least one expansion joint comprises: a fiber rope, wherein the fiber rope is disposed in the gap between the first concrete slab and the second concrete slab; a fluoroelastomer caulk, wherein the fluoroelastomer caulk is located in a first spacing between the fiber rope and the first concrete slab, and wherein the fluoroelastomer caulk is located in a second spacing between the fiber rope and the second concrete slab; and a steel plate spanning the gap between the first concrete slab and the second concrete slab, wherein the steel plate is anchored by a first fastener to the first concrete slab, and wherein the steel plate is anchored by a second fastener to the second concrete slab.

Embodiment 24. The method of Embodiment 23, wherein the first fastener and the second fastener comprise: a bolt, a screw, a nail, a staple, or any combination thereof.

Embodiment 25. The method of any one of Embodiments 14-24, wherein the at least one expansion joint has a width from 10 mm to 100 mm.

Embodiment 26. The method of any one of Embodiments 14-25, wherein the at least one expansion joint has a length from 5 m to 30 m.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains," "containing," "includes," "including," "comprises," and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. A system comprising:

a sulfur pit comprising a concrete structure having a concrete slab roof, wherein the concrete slab roof comprises a first concrete slab and a second concrete slab, wherein the first concrete slab and the second concrete slab are located adjacent to each other and are coplanar, and wherein there is a gap between the first concrete slab and the second concrete slab;

a polymer sealant disposed on an exterior surface of the concrete slab roof, wherein the exterior surface is directed toward an exterior of the sulfur pit, and wherein the exterior surface comprises exterior faces of the first concrete slab and the second concrete slab;

a refractory layer disposed on an interior surface of the concrete slab roof, wherein the interior surface is directed toward an interior of the sulfur pit, and wherein the interior surface comprises interior faces of the first concrete slab and the second concrete slab; and at least one expansion joint located in the gap between the first concrete slab and the second concrete slab, wherein the at least one expansion joint seals the gap between the first concrete slab and the second concrete slab, wherein the polymer sealant is coextensively positioned over an entirety of the exterior surface of the concrete slab roof and the expansion joint, and the refractory layer is coextensively positioned over an entirety of the interior surface of the concrete slab roof and the expansion joint.

2. The system of claim 1, wherein the polymer sealant comprises a first exterior layer and a second exterior layer, wherein the first exterior layer comprises an epoxy resin, and wherein the second exterior layer comprises a polyurethane elastomer.

3. The system of claim 1, wherein the polymer sealant further comprises a plurality of silica nanoparticles.

4. The system of claim 1, wherein the polymer sealant further comprises a plurality of fibers, a plurality of particles, or any combination thereof.

5. The system of claim 1, wherein the refractory layer comprises a first interior layer and a second interior layer, wherein the first interior layer comprises an asphalt layer, and wherein the second interior layer comprises a potassium-silicate compound.

6. The system of claim 1, wherein the at least one expansion joint has a width from 10 mm to 100 mm.

7. The system of claim 1, further comprising at least one anchor, wherein the at least one anchor joins the refractory layer to the interior surface of the concrete slab roof.

8. The system of claim 7, wherein the at least one anchor comprises a steel anchor.

9. The system of claim 1, wherein the at least one expansion joint comprises:

a fiber rope, wherein the fiber rope is disposed in the gap between the first concrete slab and the second concrete slab;

a fluoroelastomer caulk, wherein the fluoroelastomer caulk is located in a first spacing between the fiber rope and the first concrete slab, and wherein the fluoroelastomer caulk is located in a second spacing between the fiber rope and the second concrete slab; and a steel plate spanning the gap between the first concrete slab and the second concrete slab, wherein the steel plate is anchored by a first fastener to the first concrete slab, and wherein the steel plate is anchored by a second fastener to the second concrete slab.

10. The system of claim 8, wherein the first fastener and the second fastener comprise: a bolt, a screw, a nail, a staple, or any combination thereof.

11. A method comprising:

providing a sulfur pit comprising a concrete structure having a concrete slab roof, wherein the concrete slab roof comprises a first concrete slab and a second concrete slab, wherein the first concrete slab and the second concrete slab are located adjacent to each other and are coplanar, and wherein there is a gap between the first concrete slab and the second concrete slab;

disposing a polymer sealant on an exterior surface of the concrete slab roof, wherein the exterior surface is directed toward an exterior of the sulfur pit, and wherein the exterior surface comprises exterior faces of the first concrete slab and the second concrete slab;

disposing a refractory layer on an interior surface of the concrete slab roof, wherein the interior surface is directed toward an interior of the sulfur pit, and wherein the interior surface comprises interior faces of the first concrete slab and the second concrete slab; and affixing at least one expansion joint in the gap between the first concrete slab and the second concrete slab to seal said gap between the first concrete slab and the second concrete slab, wherein the polymer sealant is coextensively positioned over an entirety of the exterior surface of the concrete slab roof and the expansion joint, and the refractory layer is coextensively positioned over an entirety of the interior surface of the concrete slab roof and the expansion joint.

12. The method of claim 11, wherein the polymer sealant comprises a first exterior layer and a second exterior layer, wherein the first exterior layer comprises an epoxy resin, and wherein the second exterior layer comprises a polyurethane elastomer.

13. The method of claim 11, wherein the refractory layer comprises a first interior layer and a second interior layer, wherein the first interior layer comprises an asphalt layer, and wherein the second interior layer comprises a potassium-silicate compound.

14. The method of claim 11, further comprising at least one anchor, wherein the at least one anchor joins the refractory layer to the interior surface of the concrete slab roof.

15. The method of claim 11, wherein the at least one expansion joint comprises:

a fiber rope, wherein the fiber rope is disposed in the gap between the first concrete slab and the second concrete slab;

a fluoroelastomer caulk, wherein the fluoroelastomer caulk is located in a first spacing between the fiber rope and the first concrete slab, and wherein the fluoroelastomer caulk is located in a second spacing between the fiber rope and the second concrete slab; and a steel plate spanning the gap between the first concrete slab and the second concrete slab, wherein the steel plate is anchored by a first fastener to the first concrete slab, and wherein the steel plate is anchored by a second fastener to the second concrete slab.

* * * * *